United States Patent [19]

Nilsson

[11] 4,229,960

[45] Oct. 28, 1980

[54] TOOL FOR INSTALLING SO-CALLED PRESS NUTS

[75] Inventor: Sven R. Nilsson, Lindesberg, Sweden

[73] Assignee: Lindova Aktiebolag, Lindesberg, Sweden

[21] Appl. No.: 967,788

[22] Filed: Dec. 8, 1978

[30] Foreign Application Priority Data

Dec. 9, 1977 [SE] Sweden ..... 7714022

[51] Int. Cl.[3] ..... B21J 15/34

[52] U.S. Cl. ..... 72/114; 72/391

[58] Field of Search ..... 72/391, 114; 29/243.53, 29/243.54, 243.5

[56] References Cited

U.S. PATENT DOCUMENTS

| | | | |
|---|---|---|---|
| 2,445,067 | 7/1948 | Hiler | 72/391 |
| 2,723,777 | 11/1955 | Amtsberg | 72/114 |
| 3,181,338 | 5/1965 | Zetterlund | 72/391 |
| 3,630,427 | 12/1971 | Stokes | 72/391 |
| 3,654,292 | 4/1972 | Mead | 72/114 |
| 3,906,776 | 9/1975 | Humphreys | 29/526 |

*Primary Examiner*—Francis S. Husar
*Assistant Examiner*—Gene P. Crosby
*Attorney, Agent, or Firm*—Finnegan, Henderson, Farabow, Garrett & Dunner

[57] ABSTRACT

A tool for the installation of so-called press nuts comprises a draw bar which is axially displaceable in a housing. A draw mandrel having a threaded outer end portion for cooperation with a female thread in said press nut is connected to the outer end of said draw bar, so that the press nut can be secured in a bore of a workpiece by being upset by means of a pulling force from the draw mandrel upon axial displacement of the draw bar into said tool housing. Said draw mandrel is axially unmovably but rotatably connected relative to the draw bar. The rotor of a motor is journalled in the tool housing around the outer end of the draw bar and is drivable in one or the other direction of rotation and is arranged thereby to rotate the draw mandrel thereby to screw same into or out of the press nut before and after the upsetting of same.

6 Claims, 2 Drawing Figures

TOOL FOR INSTALLING SO-CALLED PRESS NUTS

The present invention concerns a tool for the installation of so-called press nuts.

A press nut is comprised of a rivet having a tubular shaft and a radial flange at one end thereof together with a female thread at the opposite end portion, said rivet being insertable in such a manner into aligned borings of two workpieces to be interconnected that the end flange rests against the accessible surface of the workpiece. By means of an axial pull or draw force applied to the threaded portion of said rivet shaft, while the end flange simultaneously is pressed against the accessible surface by the aid of a nose portion of said tool, the portion of the rivet shaft between said thread and said flange is deformed or upset to form an annular ridge against the inaccessible surface of the workpieces and the workpieces are clamped between said annular ridge and said flange. A threaded fastener may thereafter be screwed into the press nut.

A tool for such installation is already known, said tool comprising a housing, a draw bar which is arranged in said housing for axial displacement under the action of compressed air and at one end is connected to a draw mandrel which protrudes from said housing through a nose sleeve, arranged in said housing and serving as an anvil for the press nut, the protruding portion of said draw mandrel being provided with a male thread for cooperation with the female thread of the press nut.

This known tool, however, suffers from the disadvantage that the press nut before the installation thereof must be screwed on to the draw mandrel by hand and after the installation must be screwed out of the press nut by rotation of the whole tool. In an earlier attempt to remove this disadvantage the draw bar and draw mandrel are arranged for rotation in the housing. The rotational movement for screwing the draw mandrel into and out of the press nut has thereby been accomplished by means of a spiral ratchet screwdriver mechanism or revolving motor, arranged at the rear end of the tool, However, on account of these extra mechanisms the tool becomes bulky and heavy and therefore difficult to handle.

In the present invention the stated disadvantage is removed by means defined in the attached claims.

Figure 1:
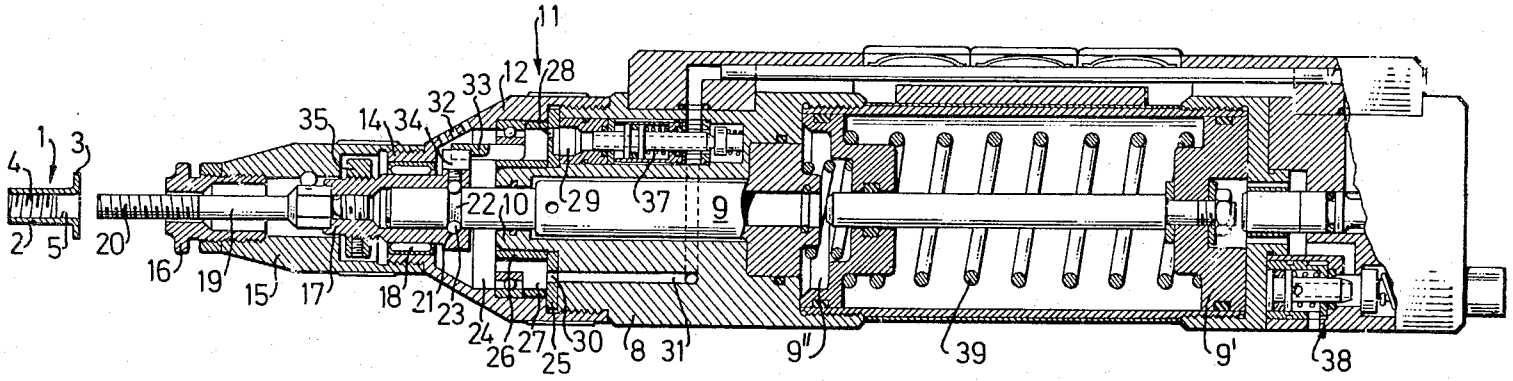
Figure 2:
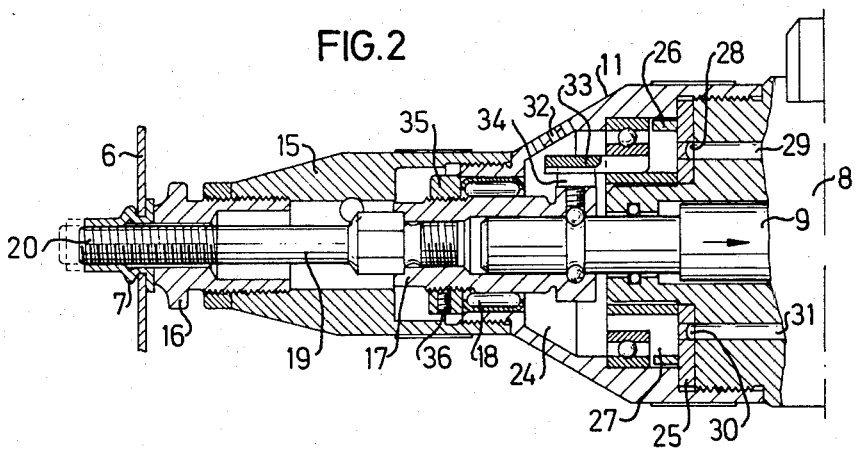

A preferred embodiment of the invention will now be described in detail with reference to the attached drawing, in which FIG. 1 in an axial section shows the tool when the press nut is to be screwed onto the draw mandrel, and FIG. 2 is a similar view showing the front portion of the tool after the installation of the press nut.

FIG. 1 shows a known press nut 1 which comprises a tubular shaft 2 having a radial end flange 3 at one end and an internally threaded portion 4 at the other end. Between the threaded portion 4 and the end flange 3 the shaft 2 is provided with an unthreaded portion 5, preferably of lesser wall thickness than said threaded portion, to facilitate the upsetting or deformation of the press nut. When the press nut is to be installed, the shaft 2 is inserted into a boring in a workpiece 6 (see FIG. 2), the end flange then thereby being pressed against the surface of the workpiece. An axial tensile force is thereafter applied to the threaded portion 4 of the shaft, whereupon the unthreaded portion 5 thereof is upset to form an annular ridge 7 at the rear surface of the workpiece, so that the press nut is securely clamped to the workpiece.

To accomplish this installation, the inventive tool has a housing which consists of a member 8 which encloses the mechanism by means of which the tensile force is applied to the press nut. Since said mechanism is of a generally known construction, it will not be described in detail. It should be sufficient to state that said mechanism comprises a draw bar 9 which is axially displaceable in the housing member 8 and sealingly extends out through one end thereof. When the press nut is to be installed, the draw bar 9 is displaced from the protruding position inwardly into the housing member 8 by the action of compressed air. The compressed air may act directly on a piston connected to the draw bar 9, but it is preferable that the force of the air piston 9' in a known manner be transferred to the draw bar 9 over a hydraulic mechanism having a differential action. Since a hydraulic mechanism of this type is a commonly known feature of drawing tool actuated by means of compressed air and does not form any part of the present invention, further description should not be necessary.

The outer end portion of the draw bar 9 is axially displaceably journalled in an annular bushing 10 which protrudes from the end surface of the housing member 8. A cylindrical cap 11 having a conically tapering central portion 12 and a cylindrical outwardly threaded end portion 14 is attached to the front end of the housing member 8. A nozzle-shaped member 15 is in its turn screwed onto the cylindrical end portion 14 and a nose sleeve 16 is screwed into the front end of said nozzle-shaped member 15.

The cylindrical end portion of the draw bar 9 protruding from the housing element 8 is accommodated in a cylindrical boring of a connecting sleeve 17 which preferably by means of a needle bearing 18 is journalled in the end portion 14 of the cap 11 for axial and rotational movement. The outwardly facing portion of the connecting sleeve 17 extends a distance into the nozzle-shaped element 15 and the end surface thereof is provided with an axial threaded boring into which the threaded end portion of a draw mandrel 19 is screwed. Said draw mandrel 19 passes through and a distance out of said nose sleeve 16 and its outer end portion is provided with a male thread 20 corresponding to the female thread of the press nut. By means of this construction a draw mandrel having a diameter corresponding to the dimensions of the press nut to be installed may easily be mounted in the tool.

Means are provided for connecting draw mandrel 19 to draw bar 9 so that the draw mandrel is axially immovable relative to the draw bar but is rotatable relative to it. As embodied, this means comprises immovably but rotatably connecting the end portion of draw bar 9 to the connecting sleeve 17. For this purpose said connecting sleeve 17 is provided with an internal annular groove 21 of semi-circular cross-section and the end portion of the draw bar 9 has a similar external annular groove 22 situated opposite to said internal annular groove 21. A plurality of balls 23 are accommodated in the toroidal space formed by said annular grooves 21 and 22 and act as connecting members between the draw bar 9 and the connecting sleeve 17. A pulling force applied to the draw bar 9 is thus transferred to the connecting sleeve 17 and to the draw mandrel 19 attached thereto and thus to the press nut threaded thereon. At the same time, however, the connecting sleeve 17 and the draw mandrel 19 are free to rotate relative to the draw bar 9.

The inner space of the cap 11 forms a turbine housing 24 which is situated around the protruding end portion of the draw bar 9 and the adjacent end of the connecting sleeve 17. The turbine housing 24 has an end wall 25 in the form of a ring-shaped disc which is clamped between an annular shoulder of the cap 11 and the end surface of the housing member 8 and surrounds the annular bushing 10 of the member 8. A turbine wheel 26 is rotatably journalled in the cylindrical portion of the cap 11 by means of ball bearings and has the form of an annular disc which surrounds the annular bushing 10 and engages the end wall 25. At the edge, the turbine wheel 26 is provided with a circular row of axial borings 27.

Means are provided for rotating the turbine wheel in either direction. As embodied, this means comprises a passage 28 formed in the end wall 25 at an angle relative to the axis of rotation of the turbine wheel 26 and the opening thereof in the surface of the end wall 25 facing the turbine wheel 26 being situated straight in front of the axial borings 27 of the turbine wheel. The opposite end of the passage 28 communicates with the passage 29 formed in the housing member 8. Diametrically opposite the passage 29, the end wall 25 is provided with a further passage 30 having the same form as the passage 28 but with an opposed angle of inclination relative to the rotational axis of the turbine wheel. At the inner end, said further passage 30 also communicates with a passage 31 in the housing member 8. By means of valve mechanisms 37 and 38 of known construction embodied in the tool, compressed air may optionally be diverted axially to displace the draw bar 9 or to pass through either of the passages 29 and 31 in the housing member 8 and from these to the cooperating passages 28 and 30, respectively, in the end wall 25. The jet of compressed air which is thereby ejected from the passage 28 or 30 causes the turbine wheel 26 to rotate in either direction. The compressed air is expelled from the turbine housing 24 through a number of outlet ports 32 provided in the outer wall of the cap 11.

Means are further provided for bringing the turbine wheel into engagement with said rotatable draw mandrel to rotate it. As embodied, turbine wheel 26 is provided with a drive member 33 which axially extends out from the turbine wheel and upon rotation thereof is moved in a circular path around the adjacent end of the connecting sleeve 17. An abutment 34 is arranged on the connecting sleeve 17 to extend radially therefrom into the path of the drive member 33. Said abutment 34 preferably consists of the head of a screw which is threaded into a radial boring in the wall of the connecting sleeve and extends in to the annular groove 21 therein, so that the balls 23 are insertable into said annular grooves 21 and 22 through said boring when the tool is assembled.

On the portion of the connecting sleeve 17, which is situated in the nozzle-shaped member 15, the connecting sleeve 17 is provided with a stop ring 35 which is axially adjustable by means of cooperating threads. The stop ring 35 is accommodated within a ring groove between the outer end 14 of the cap 11 and an annular shoulder inside the nozzle-shaped member 15, said annular groove being broader than the stop ring 35. The latter is intended to limit the length of the stroke of the draw bar 19 when the press nut is installed by coming into engagement with the end portion 14 of the cap 11. The length of the stroke can be adjusted by turning the stop ring 35 to axially displace the same relative to the connecting sleeve 17 and locking it in the position of adjustment by means of the locking screw 36.

The described tool for installing a press nut works in the following manner. The press nut 1 is brought against the threaded outer portion 20 of the draw mandrel 19 in the position shown in FIG. 1 and simultaneously the valve mechanism 37 is switched over so that the compressed air passes to the passages 28 and 29, whereby the turbine wheel 26 is caused to rotate in the screwed-in direction. The draw mandrel 19 is thereby also rotated in the same direction by the drive member 33, the abutment 34 and the connecting sleeve 17 and is threaded into the press nut, until the end flange 3 thereof engages the nose sleeve 16. The valve mechanism is thereafter switched over to a closed position, whereafter the press nut is inserted into the boring in the workpiece 6, so that the end flange 3 engages the outer surface of the workpiece 6. By actuation of the valve mechanism 38, the draw bar 9 is caused to move axially inwards into the tool and thereby exerts a pulling force on the threaded portion 4 of the press nut 1, while the end flange 3 simultaneously is pressed aganst the outer surface of the workpiece 6 by means of the nose sleeve 16, so that the press nut is upset to the shape shown in FIG. 2. When the upsetting is completed, the draw bar 9 and the draw mandrel 19 are returned to their original positions by means of a return spring 39 embodied in the tool. By means of a new actuation of the valve mechanism 37, the compressed air is passed to the passages 30,31, so that the turbine wheel 26 is rotated in the opposite direction and the draw mandrel 19, by the drive member 33 and the abutment 34, is screwed out of the installed press nut.

The tool according to the invention is not limited to the embodiment described above and may be modified in many respects without departing from the inventive idea defined in the appending claims. The turbine housing and the turbine wheel shown in the drawing may thus be replaced by any suitable motor for rotational movement actuated by compressed air.

I claim:

1. In a tool for the installation of so-called press nuts, in which the tool has a housing, a draw bar arranged in the housing for axial displacement, one end of said draw bar being operatively connected to a draw mandrel which extends out of the housing through a nose sleeve arranged thereon and in which a protruding end portion of the draw mandrel is provided with a thread for threadable engagement with said press nut, the improvement comprising means for connecting said draw mandrel to said draw bar so that the draw mandrel is axially immovably connected relative to said draw bar but is rotatable relative to said draw bar, a turbine wheel or the like that is journalled in said housing around said draw bar at the end thereof connected to the draw mandrel for rotation in either direction, means for rotating said turbine wheel in either direction and for bringing the turbine wheel into operative engagement with said rotatable draw mandrel to thereby rotate the draw mandrel and bring it into and out of threaded engagement with said press nut.

2. The tool of claim 1, in which said turbine wheel consists of a planar annular disc having a circular row of borings at the outer edge thereof, said disc being rotatably journalled in a turbine housing surrounding said draw bar and engaging a rear wall of said turbine housing, said rear wall being provided with at least one passage forming an angle with the axis of rotatation of said annular disc to direct a jet of compressed air into said axial borings in order to propel said annular disc in one direction of rotation and at least one passage forming an opposite angle with said axis of rotation to propel said annular disc in the opposite direction of rotation.

3. The tool of claims 1 or 2 in which said draw bar is connected to said draw mandrel by a connecting sleeve, one end of which is axially immovably but rotatably connected to the outer end of said draw bar, the other end of which has a threaded bore into which said draw mandrel is mounted.

4. The tool of claim 3, in which said connecting sleeve is provided with an internal annular groove of semicircular cross-section and the end portion of said draw bar has a corresponding annular groove that cooperates with the groove in the sleeve to form a toroidal space and a plurality of balls located in said toroidal space in order to form an axially, relatively immovable but rotatable connection between said draw bar and said connecting sleeve.

5. The tool of claim 3 in which the turbine wheel is provided with an axial drive member for engagement with either side of a radial abutment on said connecting sleeve to thereby rotate the draw mandrel upon rotation of the turbine wheel.

6. The tool of claim 5, in which a radial threaded bore extends through the wall of the connecting sleeve to the annular groove therein through which said balls can be inserted, and a screw threaded therein, the head of the screw serving as the abutment for the drive member of said turbine wheel.

* * * * *